US012103753B2

(12) United States Patent
Mills

(10) Patent No.: US 12,103,753 B2
(45) Date of Patent: Oct. 1, 2024

(54) SHIPPING AND DISPENSING CONSTRUCT

(71) Applicant: Graphic Packaging International, LLC, Atlanta, GA (US)

(72) Inventor: Karen L. Mills, Limerick, PA (US)

(73) Assignee: Graphic Packaging International, LLC, Atlanta, GA (US)

( * ) Notice: Subject to any disclaimer, the term of this patent is extended or adjusted under 35 U.S.C. 154(b) by 99 days.

(21) Appl. No.: 17/354,491

(22) Filed: Jun. 22, 2021

(65) Prior Publication Data

US 2021/0403217 A1 Dec. 30, 2021

Related U.S. Application Data

(60) Provisional application No. 63/043,422, filed on Jun. 24, 2020.

(51) Int. Cl.

| | |
|---|---|
| ***B65D 77/04*** | (2006.01) |
| ***B65B 5/02*** | (2006.01) |
| ***B65D 77/30*** | (2006.01) |

(52) U.S. Cl.

CPC ..... *B65D 77/0413* (2013.01); *B65B 5/024* (2013.01); *B65D 77/30* (2013.01); *B65D 2577/047* (2013.01)

(58) Field of Classification Search

CPC ..... B65D 77/0413; B65D 77/30; B65D 2577/047; B65D 2571/00327; B65D 2571/0066; B65D 71/125; B65D 2571/00141; B65D 2571/00574; B65D 2571/0079; B65D 71/0085; B65D 5/5495;

(Continued)

(56) References Cited

U.S. PATENT DOCUMENTS

| | | | |
|---|---|---|---|
| 396,570 | A | 1/1889 | Hotchkiss |
| 637,838 | A | 11/1899 | Vernon |

(Continued)

FOREIGN PATENT DOCUMENTS

| | | |
|---|---|---|
| CA | 1079240 | 6/1980 |
| EP | 0 060 504 B1 | 11/1984 |

(Continued)

OTHER PUBLICATIONS

U.S. Appl. No. 29/756,578, filed Oct. 29, 2020.

(Continued)

*Primary Examiner* — Christopher R Demeree

(74) *Attorney, Agent, or Firm* — Womble Bond Dickinson (US) LLP

(57) ABSTRACT

A shipping and dispensing construct for engaging a plurality of product holding containers includes a plurality of panels extending at least partially around an interior of the shipping and dispensing construct and comprising a front panel, a top panel, a bottom panel, at least one side panel, and at least one back panel. The shipping and dispensing construct further includes dispensing features for removal of a group of the plurality of the product holding containers, the dispensing features including a plurality of dispensing portions comprising at least a portion of at least one of the top panel and the bottom panel, the dispensing portions being separable from a remainder of the shipping and dispensing construct for allowing access to a group of the plurality of product holding containers.

40 Claims, 9 Drawing Sheets

(58) Field of Classification Search
CPC ..... B65D 2571/00864; B65B 5/024; B65B 43/10
USPC ..... 229/120.011; 206/427, 170, 174, 175, 206/747; 221/305
See application file for complete search history.

(56) References Cited

U.S. PATENT DOCUMENTS 1,373,365 A 3/1921 Smouse
1,833,605 A 11/1931 Gates, Jr.
1,892,756 A 1/1933 Van Home
2,330,521 A 9/1943 Scheide
2,341,762 A 2/1944 Conklin
2,355,729 A 8/1944 Inman
2,355,730 A 8/1944 Inman
2,359,986 A 10/1944 Grecco
2,662,684 A 12/1953 Robins
2,671,584 A 3/1954 Taylor, Jr.
2,684,178 A 7/1954 Keeler
2,723,027 A 11/1955 Reynolds
2,811,250 A 10/1957 Arneson
2,872,036 A 2/1959 Forrer
2,888,132 A 5/1959 Guyer
3,027,063 A 3/1962 Zastrow
3,071,244 A 1/1963 Doran
3,127,991 A 4/1964 Burnett
3,136,410 A 6/1964 Sanford
3,144,190 A 8/1964 Holt
3,158,312 A 11/1964 Simkins
3,186,587 A 6/1965 Englander
3,263,807 A 8/1966 Fingerhut
3,315,875 A 4/1967 Rudolf
3,323,639 A 6/1967 Krzyzanowski
3,324,999 A 6/1967 Farquhar
3,326,369 A 6/1967 Tolaas
3,355,089 A 11/1967 Champlin
3,375,968 A 4/1968 Weiss
3,392,878 A 7/1968 Jackson
3,447,735 A 6/1969 Whitney
3,493,106 A 2/1970 Galli
D217,441 S 5/1970 Kanaga
3,528,598 A 9/1970 Lock
3,635,393 A 1/1972 Herglotz
3,756,502 A 9/1973 Swanson
3,840,171 A 10/1974 Waters
3,840,172 A 10/1974 Zimmermann
3,872,965 A 3/1975 Taub
3,886,901 A 6/1975 Zeitter
3,918,584 A 11/1975 Richardson
3,935,943 A 2/1976 Meyer
3,949,928 A 4/1976 Perkins
4,068,795 A 1/1978 Forster
4,082,215 A 4/1978 Eichenauer
D250,093 S 10/1978 Schillinger
4,170,325 A 10/1979 Pawlowski
4,192,445 A 3/1980 Card
4,252,236 A 2/1981 Roccaforte
4,277,015 A 7/1981 Crane
D260,076 S 8/1981 Schillinger
4,328,923 A 5/1982 Graser
4,340,169 A 7/1982 Webinger
4,415,082 A 11/1983 Martin
4,449,633 A 5/1984 Johnson et al.
D281,484 S 11/1985 Dickes
4,696,402 A 9/1987 Harmon et al.
4,790,436 A 12/1988 Nakamura
4,794,005 A 12/1988 Swiontek
4,817,866 A 4/1989 Wonnacott
4,860,944 A 8/1989 Wonnacott
4,865,187 A 9/1989 Zulauf
4,895,295 A 1/1990 Montgomery
D306,699 S 3/1990 Michau
4,905,837 A 3/1990 Schuster et al.
4,928,817 A 5/1990 Focke
4,944,405 A 7/1990 Buford
4,961,501 A 10/1990 Hansmann
5,016,813 A 5/1991 Simons
5,020,663 A 6/1991 Dallas
5,044,503 A 9/1991 Wein
5,048,687 A 9/1991 Suzuki
D320,557 S 10/1991 Schuster
5,094,359 A 3/1992 DeMars et al.
5,125,565 A 6/1992 Rogers
5,170,934 A 12/1992 Lemoine
5,292,058 A 3/1994 Zoss et al.
5,294,044 A 3/1994 Clark
5,307,986 A 5/1994 Schuster
5,388,758 A 2/1995 Scovell
5,411,204 A 5/1995 Demay
5,505,369 A 4/1996 Taliaferro
5,520,284 A 5/1996 Gray
5,522,538 A 6/1996 Gray
5,570,808 A 11/1996 Tassoni
5,590,813 A 1/1997 Abramczyk
5,607,056 A 3/1997 Whiteside
5,675,960 A 10/1997 Weaver
5,871,090 A 2/1999 Doucette et al.
6,041,997 A 3/2000 Jensen
6,126,065 A 10/2000 Wee
6,155,412 A 12/2000 Le Bras
6,305,598 B1 10/2001 Bryan
D458,127 S 6/2002 De Groote
D467,499 S 12/2002 Garza et al.
D473,787 S 4/2003 Jones, Jr. et al.
6,554,135 B1 4/2003 Luceri
D478,737 S 8/2003 Sparkowski
D484,043 S 12/2003 Hwang et al.
D484,799 S 1/2004 Hoffman
6,676,010 B1 1/2004 Roseth et al.
D486,390 S 2/2004 Auclair
6,729,475 B2 * 5/2004 Yuhas ..... B65D 5/5495 229/120.08
D495,953 S 9/2004 Miller
6,808,107 B2 10/2004 Jackson
D505,620 S 5/2005 Huebsch
6,938,818 B2 9/2005 Moorman
6,981,631 B2 1/2006 Fogle et al.
D515,942 S 2/2006 Hamblin
D519,366 S 4/2006 Epstein
7,021,525 B2 4/2006 Jouppi et al.
D519,830 S 5/2006 Yocum
7,097,041 B2 8/2006 Marrale
7,234,593 B2 6/2007 Fath
D561,023 S 2/2008 Jacxsens
7,380,701 B2 6/2008 Fogle et al.
D590,244 S 4/2009 Demalsche
7,552,820 B2 6/2009 Kohler
7,624,911 B2 12/2009 Spurrell
7,669,755 B2 3/2010 Smalley
7,699,214 B2 4/2010 Mestre et al.
D622,589 S 8/2010 Elias
D629,296 S 12/2010 De Muynck
D630,508 S 1/2011 Hubbard, Jr.
D631,741 S 2/2011 Hubbard, Jr.
D631,742 S 2/2011 Hubbard, Jr.
D631,743 S 2/2011 Hubbard, Jr.
D637,078 S 5/2011 Peng
7,938,257 B2 5/2011 Kohler
8,028,839 B2 10/2011 Learn
D656,394 S 3/2012 Smith
D666,830 S 9/2012 Glenn
D668,533 S 10/2012 Collins
D684,858 S 6/2013 Sill
8,701,974 B2 4/2014 Davies
D706,129 S 6/2014 Boraczek
8,740,050 B2 6/2014 Zinck et al.
D717,162 S 11/2014 Baker
D719,018 S 12/2014 Levy
9,033,209 B2 5/2015 Fogle et al.
9,073,658 B2 7/2015 Spivey, Sr. et al.
D741,175 S 10/2015 Amindjanov
9,162,793 B2 10/2015 Stewart
9,169,037 B2 10/2015 Pinkstone
9,211,971 B2 12/2015 Fogle et al.

(56) References Cited

U.S. PATENT DOCUMENTS

| | | | |
|---|---|---|---|
| 9,248,933 | B2 | 2/2016 | Spivey, Sr. et al. |
| D753,994 | S | 4/2016 | Pantelleria |
| 9,309,023 | B2 | 4/2016 | Hubbard, Jr. |
| 9,321,553 | B1 | 4/2016 | Spivey, Sr. et al. |
| D755,624 | S | 5/2016 | Ng |
| 9,346,234 | B2 | 5/2016 | Hajek et al. |
| D762,468 | S | 8/2016 | Pantelleria et al. |
| D764,271 | S | 8/2016 | Sanfilippo |
| D769,114 | S | 10/2016 | Montemayor |
| 9,505,516 | B2 | 11/2016 | Hubbard, Jr. |
| D775,947 | S | 1/2017 | Epstein |
| 9,701,438 | B2 | 7/2017 | Fitzwater et al. |
| D805,894 | S | 12/2017 | Lee |
| 9,845,182 | B2 | 12/2017 | Baldino |
| D809,930 | S | 2/2018 | Kagawa |
| D810,561 | S | 2/2018 | Garnett |
| D811,875 | S | 3/2018 | Haen et al. |
| D813,029 | S | 3/2018 | Borkovetz et al. |
| D814,296 | S | 4/2018 | Collins |
| 10,017,290 | B2 | 7/2018 | Faulkner et al. |
| 10,086,972 | B2 | 10/2018 | Hajek |
| D834,411 | S | 11/2018 | Vanderhulst |
| D838,587 | S | 1/2019 | Laliberte |
| D842,695 | S | 3/2019 | Haen |
| 10,232,973 | B2 | 3/2019 | Burke |
| 10,239,651 | B2 | 3/2019 | Exner et al. |
| D848,835 | S | 5/2019 | Exner |
| D861,484 | S | 10/2019 | Patel |
| D864,751 | S | 10/2019 | Exner |
| D864,753 | S | 10/2019 | Exner |
| D866,321 | S | 11/2019 | Bennett |
| D880,999 | S | 4/2020 | Sill |
| D887,830 | S | 6/2020 | Kirchen |
| D891,917 | S | 8/2020 | Candan |
| D897,839 | S | 10/2020 | Vanderhulst |
| D899,922 | S | 10/2020 | Sanfilippo |
| D901,241 | S | 11/2020 | Cohen |
| D904,870 | S | 12/2020 | Sill |
| D912,508 | S | 3/2021 | Kirchen |
| D917,279 | S | 4/2021 | Blomberg |
| D918,030 | S | 5/2021 | Wan |
| D918,036 | S | 5/2021 | David |
| D920,099 | S | 5/2021 | Stabile |
| D923,473 | S | 6/2021 | Jacobsson |
| D939,340 | S | 12/2021 | Moffat |
| 11,203,460 | B2 | 12/2021 | Hokanson |
| D949,010 | S | 4/2022 | Sill |
| D966,098 | S | 10/2022 | Gonzalez Manzano |
| D968,952 | S | 11/2022 | Chambers |
| D974,906 | S | 1/2023 | Vanderhulst |
| D975,540 | S | 1/2023 | Castro |
| D996,207 | S | 8/2023 | Weaver |
| D996,214 | S | 8/2023 | Genord |
| 11,807,432 | B2 | 11/2023 | Weaver |
| D1,009,621 | S | 1/2024 | Houkom |
| D1,028,705 | S | 5/2024 | Tipping |
| 2004/0031842 | A1 | 2/2004 | Westerman et al. |
| 2004/0182916 | A1 | 9/2004 | Roseth |
| 2004/0226988 | A1 | 11/2004 | Fogle |
| 2004/0245327 | A1 | 12/2004 | Oliff |
| 2005/0045706 | A1 | 3/2005 | Varanasi |
| 2005/0056554 | A1 | 3/2005 | Fath et al. |
| 2005/0092649 | A1 | 5/2005 | Ford |
| 2005/0279815 | A1 | 12/2005 | Fogle et al. |
| 2006/0255105 | A1 | 11/2006 | Sweet |
| 2007/0095881 | A1 | 5/2007 | Manaige |
| 2007/0295796 | A1 | 12/2007 | Sutherland |
| 2008/0087679 | A1 | 4/2008 | Cook |
| 2009/0039144 | A1 | 2/2009 | Hooi et al. |
| 2009/0302098 | A1* | 12/2009 | Learn ..... B65D 5/5019 220/735 |
| 2010/0108748 | A1 | 5/2010 | Fleming |
| 2011/0215110 | A1 | 9/2011 | Kadhum |
| 2011/0226847 | A1 | 9/2011 | Nakano |
| 2012/0273387 | A1 | 11/2012 | Ivosevic |
| 2012/0298732 | A1 | 11/2012 | Stewart |
| 2013/0112592 | A1 | 5/2013 | Bowers et al. |
| 2013/0334096 | A1 | 12/2013 | Fath |
| 2014/0096488 | A1 | 4/2014 | Gonzalez |
| 2014/0263600 | A1 | 9/2014 | Valencia |
| 2015/0083625 | A1 | 3/2015 | Paredes et al. |
| 2016/0101917 | A1 | 4/2016 | Spivey, Sr. |
| 2016/0176569 | A1 | 6/2016 | Hanke |
| 2017/0267397 | A1 | 9/2017 | Cooper |
| 2017/0297796 | A1 | 10/2017 | Ball |
| 2019/0291932 | A1 | 9/2019 | Chevalier |
| 2020/0189818 | A1 | 6/2020 | McCree et al. |
| 2020/0207055 | A1 | 7/2020 | Wirtz |
| 2021/0016916 | A1* | 1/2021 | Ford ..... B65D 71/36 |
| 2021/0309412 | A1 | 10/2021 | Abjean |
| 2021/0403198 | A1 | 12/2021 | Hajek |
| 2021/0403199 | A1 | 12/2021 | Weaver |
| 2021/0403215 | A1* | 12/2021 | Pinkstone ..... B65B 13/02 |
| 2021/0403216 | A1* | 12/2021 | Mills ..... B65B 5/06 |
| 2021/0403217 | A1 | 12/2021 | Mills |
| 2022/0017259 | A1 | 1/2022 | Barbieri |
| 2023/0013072 | A1 | 1/2023 | Stiess |
| 2023/0356868 | A1 | 11/2023 | Scapin |
| 2023/0373675 | A1 | 11/2023 | Telman |

FOREIGN PATENT DOCUMENTS

| | | | | |
|---|---|---|---|---|
| EP | 0 647 199 | B1 | 5/2000 | |
| EP | 1 348 638 | A1 | 10/2003 | |
| EP | 1 200 316 | B1 | 6/2004 | |
| EP | 2 008 937 | A1 | 12/2008 | |
| EP | 2 493 772 | B1 | 6/2014 | |
| GB | 2 387 591 | | 10/2003 | |
| JP | 3062562 | U | 10/1999 | |
| JP | 2004-123101 | | 4/2004 | |
| JP | 2009-073536 | | 4/2009 | |
| JP | 2011-093601 | A | 5/2011 | |
| KR | 20-0171748 | | 3/2000 | |
| KR | 20-0450117 | Y1 | 9/2010 | |
| WO | WO 89/10308 | | 11/1989 | |
| WO | WO 95/25046 | A1 | 9/1995 | |
| WO | WO 98/47417 | | 10/1998 | |
| WO | WO 00/71427 | A1 | 11/2000 | |
| WO | WO-0078619 | A2 * | 12/2000 | ..... B65D 5/5495 |
| WO | WO 2010/006629 | A1 | 1/2010 | |
| WO | WO 2012/148986 | A1 | 11/2012 | |

OTHER PUBLICATIONS

U.S. Appl. No. 29/756,579, filed Oct. 29, 2020.
U.S. Appl. No. 29/756,580, filed Oct. 29, 2020.
U.S. Appl. No. 29/756,581, filed Oct. 29, 2020.
U.S. Appl. No. 29/753,802, filed Oct. 2, 2020.
U.S. Appl. No. 17/354,468, filed Jun. 22, 2021.
U.S. Appl. No. 17/354,475, filed Jun. 22, 2021.
U.S. Appl. No. 17/354,486, filed Jun. 22, 2021.
U.S. Appl. No. 17/354,454, filed Jun. 22, 2021.
International Search Report and Written Opinion for PCT/US2021/038438 dated Oct. 6, 2021.
Colpac Vizione Cardboard Food Tray. [online] Published on Apr. 20, 2017. Retrieved Dec. 18, 2018 from URL: http://www.castawayfoodpackaging.co.nz/product/01viztfl-vizione-cardboard-food-tray.
International Search Report and Written Opinion for PCT/US2021/038431 dated Oct. 18, 2021.
International Search Report and Written Opinion for PCT/US2021/038434 dated Oct. 19, 2021.
International Search Report and Written Opinion for PCT/US2021/038435 dated Oct. 21, 2021.
International Search Report and Written Opinion for PCT/US2021/038427 dated Oct. 18, 2021.
SIDEL wrap around case packer, posted at sidel.com (date not available), [site visited Oct. 16, 2023]. Available from internet, URL: <https://www.sidel.com/en/overwrapping-packing/wrap-around-blank-packing/cermex-wb-bb-pd-384> (Year: NA).

(56) References Cited

OTHER PUBLICATIONS

Supplementary European Search Report for EP 21 82 8680 dated Jun. 21, 2024.
Supplementary European Search Report for EP 21 82 9870 dated Jun. 25, 2024.

* cited by examiner

SHIPPING AND DISPENSING CONSTRUCT

CROSS-REFERENCE TO RELATED APPLICATION

This application claims the benefit of U.S. Provisional Patent Application No. 63/043,422, filed on Jun. 24, 2021.

INCORPORATION BY REFERENCE

The disclosures of U.S. Provisional Patent Application No. 63/043,422 filed on Jun. 24, 2021 and U.S. Design patent application No. 29/756,581, filed on Oct. 29, 2020.

BACKGROUND OF THE DISCLOSURE

The present disclosure generally relates to shipping and dispensing constructs and/or cartons for holding and dispensing containers or other types of articles. More specifically, the present disclosure relates to a shipping and dispensing construct for holding and dispensing a plurality of containers such as product holding containers, the shipping and dispensing construct having features to facilitate dispensing one or more of the product holding containers.

SUMMARY OF THE DISCLOSURE

According to one aspect, the disclosure is generally directed to a shipping and dispensing construct for engaging a plurality of product holding containers, the shipping and dispensing construct comprising a plurality of panels extending at least partially around an interior of the shipping and dispensing construct and comprising a front panel, a top panel, a bottom panel, at least one side panel, and at least one back panel. The shipping and dispensing construct further comprises dispensing features for removal of a group of the plurality of the product holding containers, the dispensing features including a plurality of dispensing portions comprising at least a portion of at least one of the top panel and the bottom panel, the dispensing portions being separable from a remainder of the shipping and dispensing construct for allowing access to a group of the plurality of product holding containers.

According to another aspect, the disclosure is generally directed to a construct blank for forming a shipping and dispensing construct for engaging a plurality of product holding containers, the construct blank comprising a plurality of panels for extending at least partially around an interior of the shipping and dispensing construct formed from the blank and comprising a front panel, a top panel, a bottom panel, at least one side panel, and at least one back panel. The construct blank further comprises dispensing features for facilitating selective dispensing of one or more of the product holding containers when the shipping and dispensing construct is formed from the construct blank, the dispensing features including a plurality of dispensing portions comprising a plurality of separable portions of at least one of the top panel and the bottom panel for attachment to a respective container of the plurality of product holding containers.

According to another aspect, the disclosure is generally directed to a method of forming a shipping and dispensing construct, the method comprising obtaining a construct blank comprising a plurality of panels comprising a front panel, a top panel, a bottom panel, at least one side panel, and at least one back panel, and dispensing features including a plurality of dispensing portions comprising at least a portion of at least one of the top panel and the bottom panel. The method further comprises folding the plurality of panels at least partially around an interior of the shipping and dispensing construct such that the dispensing portions are separable from a remainder of the shipping and dispensing construct.

According to another aspect, the disclosure is generally directed to a package, the package comprising a plurality of product holding containers and a shipping and dispensing construct engaging the plurality of product holding containers. The shipping and dispensing construct comprises a plurality of panels extending at least partially around an interior of the package and comprising a front panel, a top panel, a bottom panel, at least one side panel, and at least one back panel. The shipping and dispensing construct further comprises dispensing features for removal of a group of the plurality of the product holding containers, the dispensing features comprising a plurality of dispensing portions including at least a portion of at least one of the top panel and the bottom panel, the dispensing portions being separable from a remainder of the shipping and dispensing construct for allowing access to the group of the plurality of product holding containers.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to constructs, cartons, carriers, clips, sleeves, or the like, and packages for shipping and dispensing articles such as containers, cartons, constructs, sleeves, etc. that hold a product. The containers can be product holding containers used for packaging consumer products such as soap or other personal care products, but the product holding containers could hold other products such as food and beverage products, or any other suitable product. The product holding containers can be made from materials suitable in composition for packaging the particular consumer product or item, and the materials include, but are not limited to, paperboard, composite paperboard, and the like; plastics such as PET, LDPE, LLDPE, HDPE, PP, PS, PVC, EVOH, and Nylon, or any combination thereof, or any other suitable material.

Constructs according to the present disclosure can accommodate articles of any shape. For the purpose of illustration and not for the purpose of limiting the scope of the disclosure, the following detailed description describes product holding containers (e.g., paperboard cartons having closed ends, cuboid paperboard boxes, etc.) as associated with the shipping and dispensing construct embodiments and/or as disposed within the construct embodiments. In this specification, the terms "inner," "interior," "outer," "exterior," "lower," "bottom," "upper," and "top" indicate orientations determined in relation to fully erected and upright constructs and cartons.

As described herein, constructs/containers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
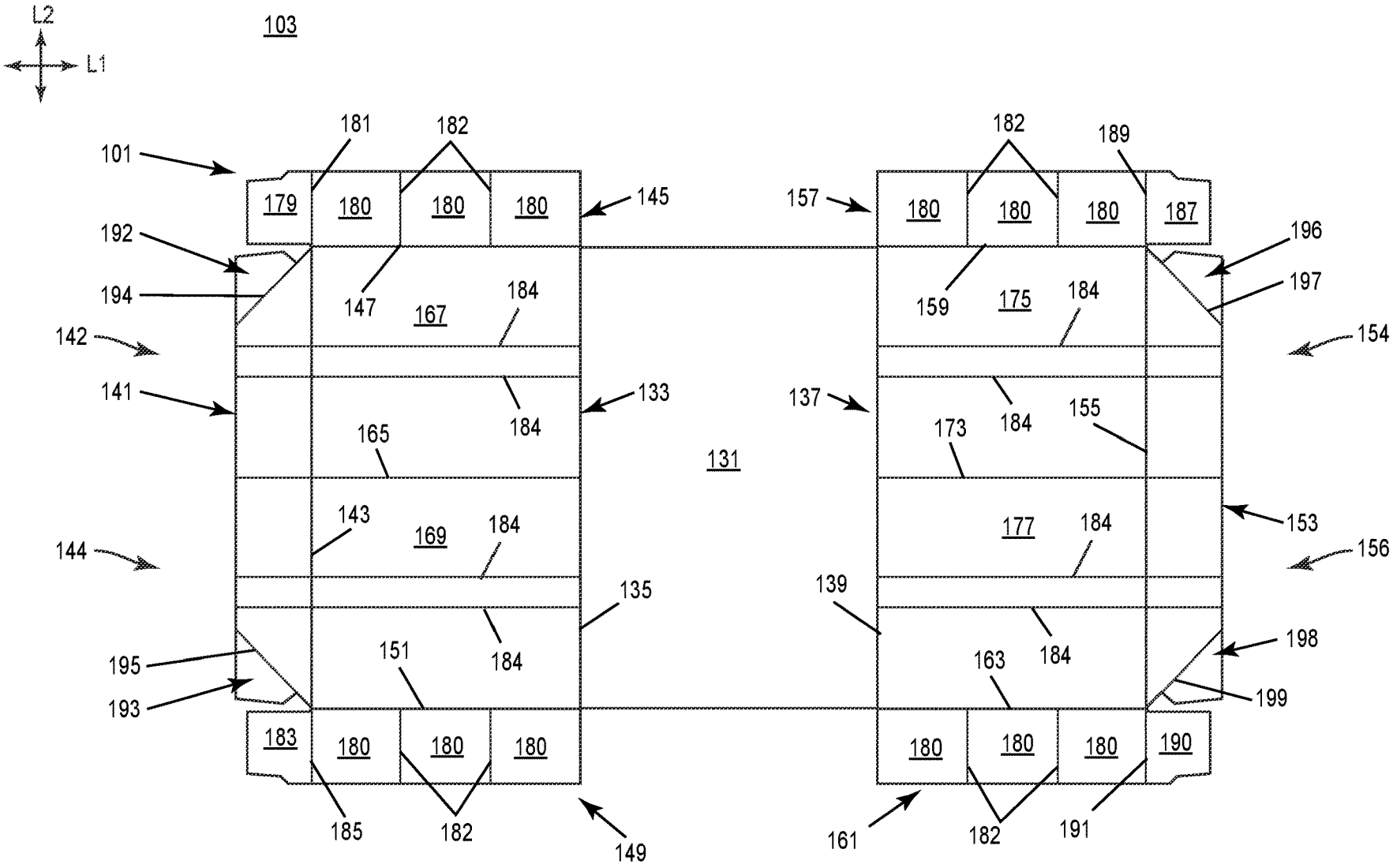
FIG. 1 is a plan schematic view of an exterior surface of a construct blank for forming a shipping and dispensing construct according to a first exemplary embodiment of the disclosure.

FIG. 1 is a plan view of an interior surface 101 of a construct blank 103 used to form a shipping and dispensing construct 105 (FIG. 3) according to an exemplary embodiment of the disclosure. The construct 105 can be used to at least partially hold/support/retain a plurality of product holding containers C securely for shipping from the product holding container supplier to a point-of-sale vendor (e.g., department store, grocery store, pharmacy, etc.) where the construct 105 can be displayed for purchase by a consumer and/or for dispensing or access by one or more product holding containers C to the consumer.

In one embodiment, the construct 105 has attachment features for securely attaching the product holding containers C to the construct 105 and can also include dispensing features for allowing the respective product holding containers C to be accessed/released/removed/dispensed from the construct 105 by the consumer. As described herein, the dispensing features of the construct 105 can include dispensing portions that are separable from a remainder of the shipping and dispensing construct 105. It will be understood that, in one or more embodiments, one or more of the attachment features can be separable from one or more other portions of the construct 105 so as to also be considered dispensing features of the construct 105.

In one embodiment, twelve product holding containers C are contained in the construct 105 and can be arranged in two rows of two containers stacked in three tiers (e.g., 2×2×3), but more or less than twelve product holding containers C can be contained in the construct 105 and the product holding containers can be differently arranged without departing from the disclosure.

Figure 5:
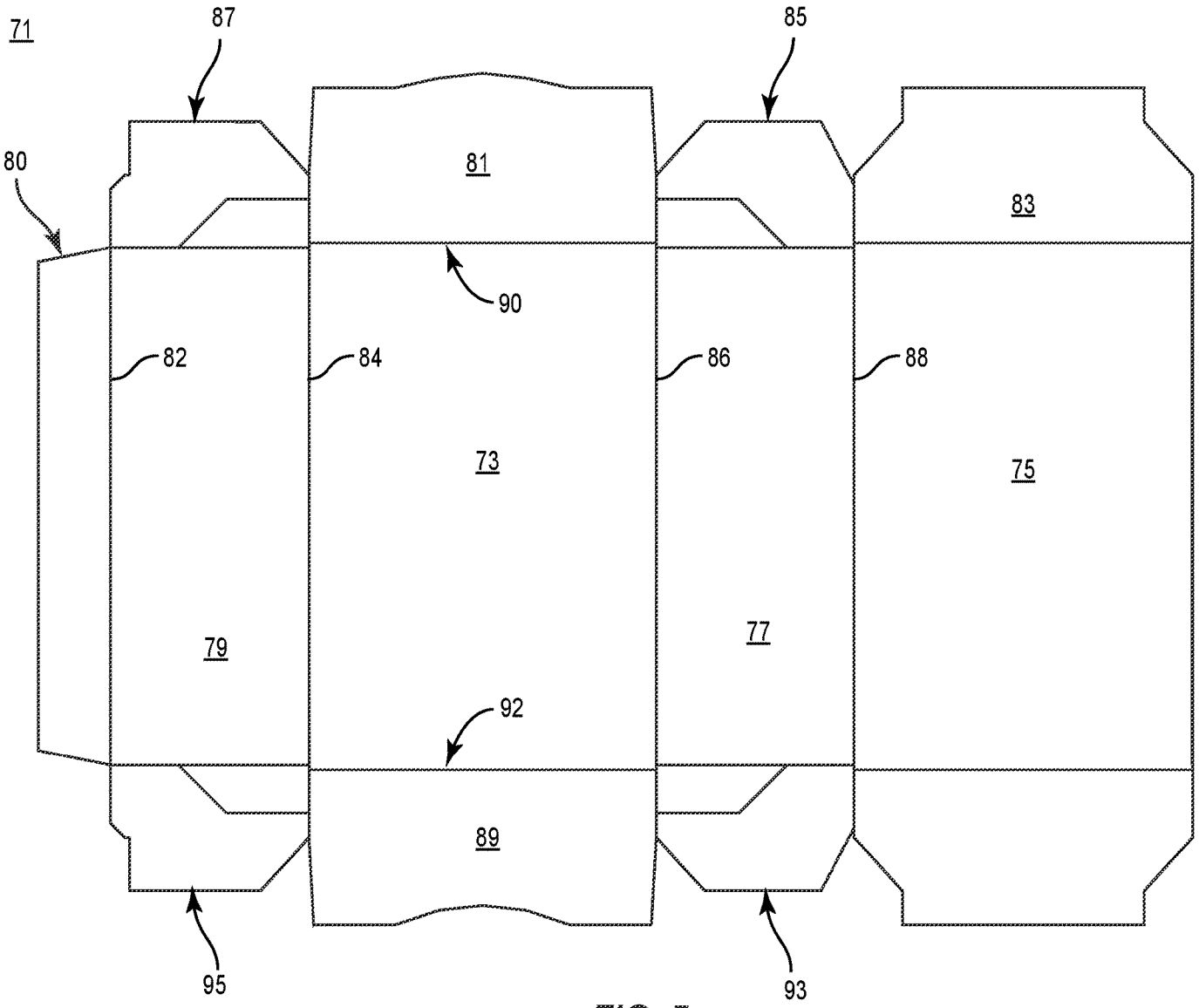
FIG. 5 is a plan schematic view of a blank for forming a product holding container for use with various embodiments of the disclosure.

In the illustrated embodiment, the product holding containers C are illustrated as paperboard cartons formed by the carton blank 71 (FIG. 5) that hold a consumer product (e.g., soap or other personal care or consumer products). As shown in FIG. 5, the carton blank 71 can have a top panel 73, a bottom panel 75, two side panels 77, 79, and an attachment flap 80. The carton blank 71 can also include end flaps 81, 83, 85, 87 for closing a first end of the containers C and second end flaps 89, 91, 93, 95 for closing a second end of the containers C. In the illustrated arrangement, the attachment flap 80, side panel 79, top panel 73, side panel 77, and bottom panel 75 can be foldably connected at respective lateral fold lines 82, 84, 86, 88, the end flaps 81, 83, 85, 87 can be foldably connected to respective panels of the plurality of panels of the carton blank 71 at respective portions of a longitudinal fold line 90, and the end flaps 89, 91, 93, 95 can be foldably connected to respective panels of the plurality of panels of the carton blank 71 at respective portions of a longitudinal fold line 92. Other containers may be held in the shipping and dispensing construct 105, and/or the containers C can have a different configuration, without departing from the disclosure.

Still referring to FIG. 1, the construct blank 103 has a longitudinal axis L1 and a lateral axis L2. In the illustrated embodiment, the construct blank 103 has a front panel 131 foldably connected to a bottom panel 133 at a lateral fold line 135 and foldably connected to a top panel 137 at a lateral fold line 139. The bottom panel 133 can be foldably connected to a first or bottom back panel 141 at a lateral fold line 143, can be foldably connected to a first bottom side panel 145 at a longitudinal fold line 147, and can be foldably connected to a second bottom side panel 149 at a lateral fold line 151.

Similarly, the top panel 137 can be foldably connected to a second or top back panel 153 at a lateral fold line 155, can be foldably connected to a first top side panel 157 at a longitudinal fold line 159, and can be foldably connected to a second top side panel 161 at a lateral fold line 163.

As shown, the bottom panel 133 can be bisected by a longitudinal tear line 165 such that a first portion 167 of the bottom panel 133 is separably connected to a second portion 169 of the bottom panel 131. The tear line 165 can also extend into the bottom back panel 141 to bisect the bottom back panel 141 into a first portion 142 and a second portion 144. As described herein, the portions 167, 169 of the bottom panel 133 and/or the portions 142, 144 of the bottom back panel 141 can form dispensing portions of the shipping and dispensing construct 105.

Similarly, the top panel 137 can be bisected by a longitudinal fold line 173 such that a first portion 175 of the top panel 137 is separably connected to a second portion 177 of the top panel 137, and the tear line 173 can extend into the top back panel 153 to bisect the top back panel 153 into a first portion 154 and a second portion 156. As described herein, the portions 175, 177 of the top panel 137 and/or the portions 154, 156 of the top back panel 153 can form dispensing portions of the shipping and dispensing construct 105.

The construct blank 103 can also include a plurality of end flaps separably/foldably connected to respective panels, and as shown, can include a first bottom side end flap 179 separably/foldably connected to the side panel 145 at a lateral tear line 181, a second bottom side end flap 183 separably/foldably connected to the side panel 149 at a lateral tear line 185, a first top side end flap 187 separably/foldably connected to the side panel 157 at a lateral tear line 189, and a second top side end flap 190 separably/foldably connected to the side panel 161 at a lateral tear line 191.

As also shown, attachment flaps 192, 193 can be separably/foldably connected to the back panel 141 at respective oblique fold line 194, 195, and attachment flaps 196, 198 can be separably/foldably connected to the back panel 153 at respective oblique fold lines 197, 199.

With continued reference to FIG. 1, the side panels 145, 149, 157, 161 can each include separating features or dispensing portions in the form of separable panel sections 180, each adjacent panel section 180 separable from one another at respective lateral tear lines 182. It will be understood that the first portion 167 and the second portion 169 of the bottom panel 133 and the first portion 175 and the second portion 177 of the top panel 137 can also form separating features of the blank 103/construct 105.

It will be understood that the blank 103 and the construct 105 formed therefrom can have a different arrangement of panels, flaps, sections, etc. without departing from the disclosure. As shown, the blank 103 and the construct 105 therefrom can include one or more lines of weakening to facilitate formation and maintenance of the construct 105, movement of the construct 105, gluing, etc., and can include longitudinal creases/longitudinal lines of weakening 184 to facilitate relative movement of portions of the panels 133, 137.

Figure 2:
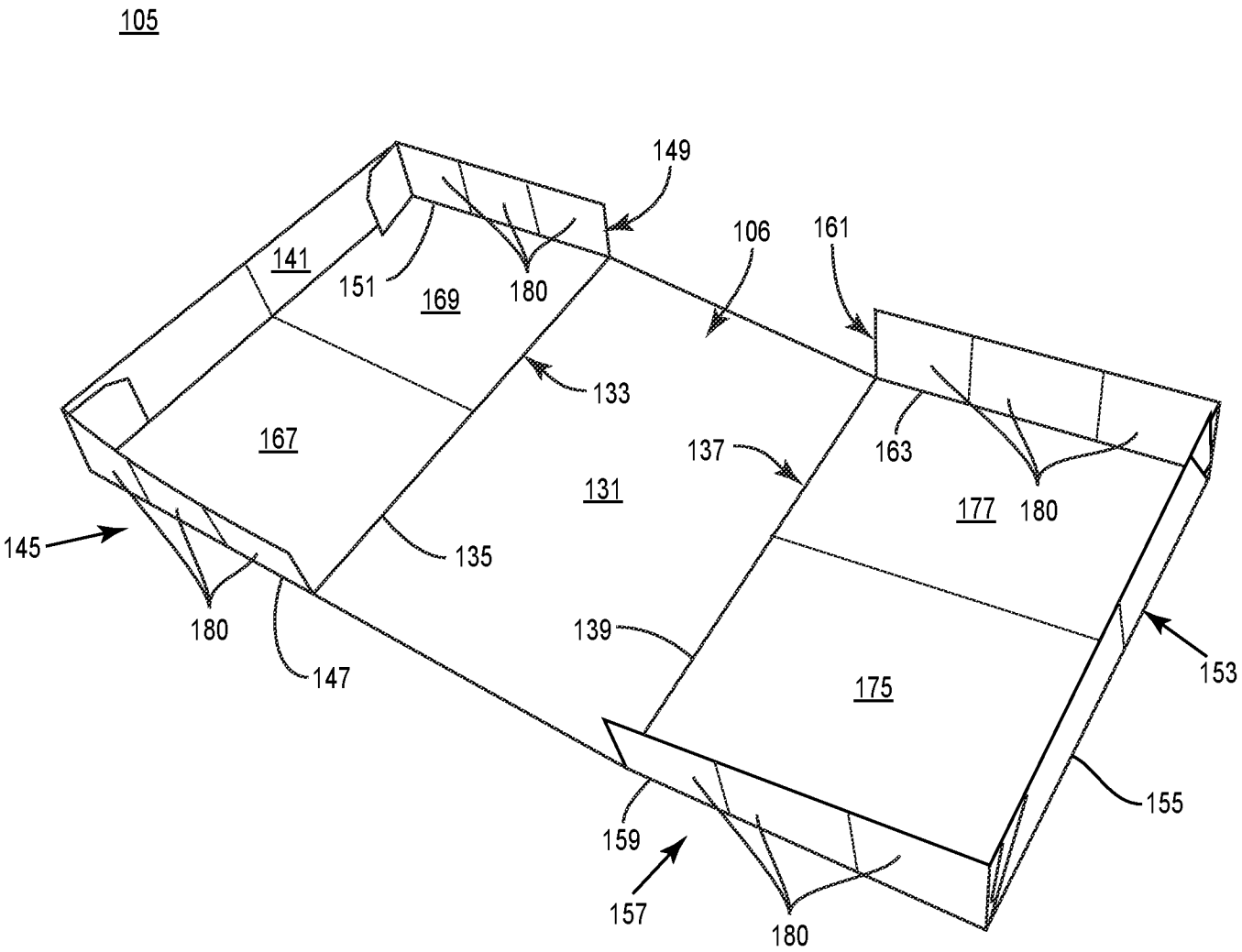
FIG. 2 is a perspective view of a partially folded configuration of a shipping and dispensing construct formed from the blank of FIG. 1 according to the first exemplary embodiment.
Figure 3:
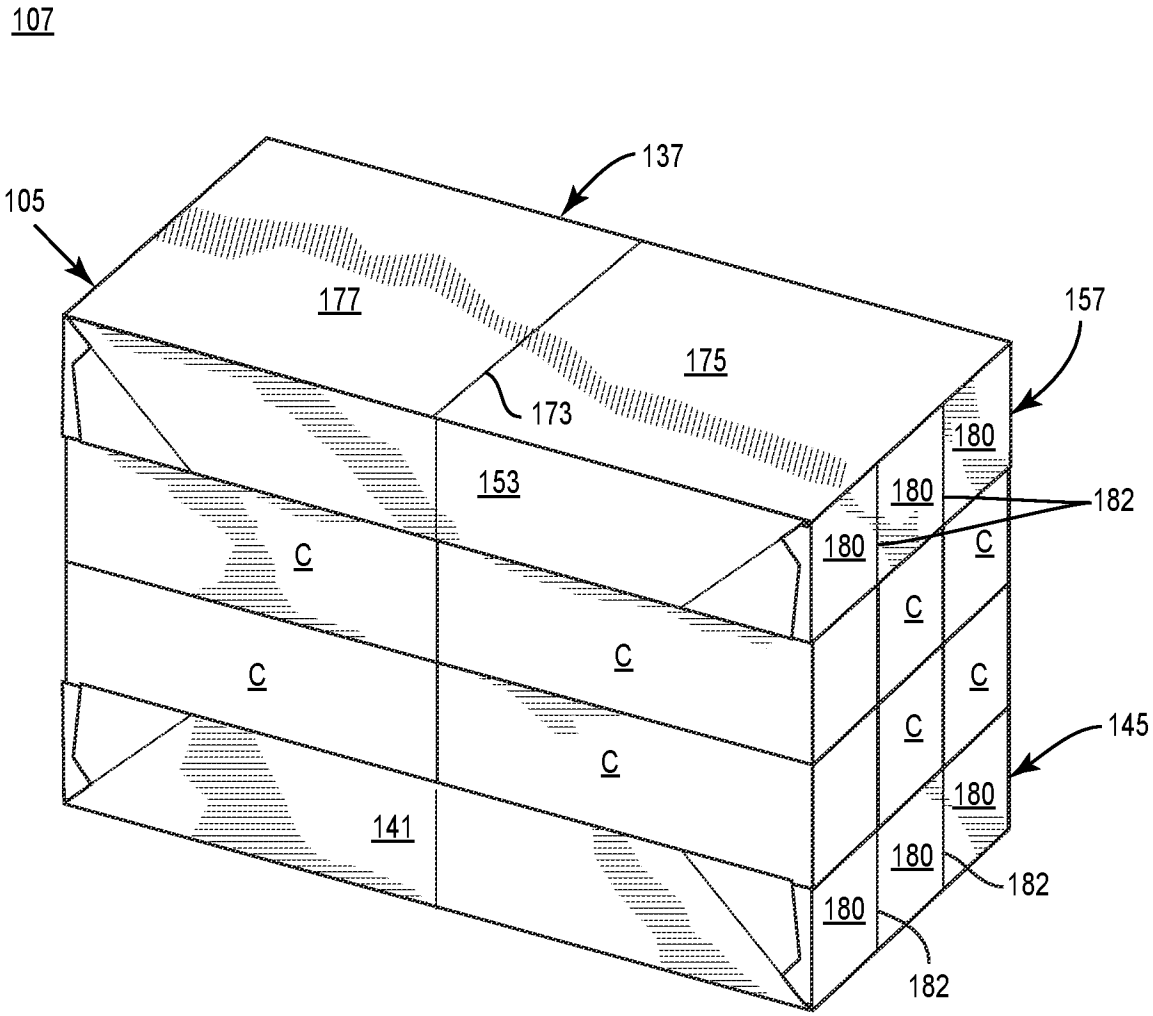
FIG. 3 is a perspective view of a package and shipping and dispensing construct formed from the blank of FIG. 1 according to the first exemplary embodiment.

With additional reference to FIGS. 2 and 3, according to one embodiment, one or more of the product holding containers C can be placed on the front panel 131, and the bottom panel 133 and the top panel 137 can be folded upwardly at the respective fold lines 135, 139 into at least partial face-to-face contact with the containers C. The bottom side panels 145, 149 can be folded at the respective fold lines 147, 151 into at least partial face-to-face contact with respective containers C, and, simultaneously or thereafter, the bottom back panel 141 can be folded at the fold line 143 into at least partial face-to-face contact with respective containers C. In such an arrangement, the end flaps 179, 183 can be folded at the respective fold lines 181, 185 and positioned in at least partial overlapping face-to-face contact with the back panel 141.

Similarly, the top side panels 157, 161 can be folded at the respective fold lines 159, 163 into at least partial face-to-face contact with respective containers C, and, simultaneously or thereafter, the top back panel 153 can be folded at the fold line 155 into at least partial face-to-face contact with respective containers C, with the end flaps 187, 190 folded at the respective fold lines 189, 191 and positioned in at least partial overlapping face-to-face contact with the back panel 153.

One or more of the panels 133, 137, 145, 149, 151, 157, 161 can be attached to respective containers C with an adhesive, for example, glue. In the illustrated embodiment, the glue could be a releasable glue, such as fugitive glue, or any other suitable adhesive without departing from the disclosure.

In view of the foregoing, the shipping and dispensing construct 105 can at least partially extend around a 2×2×3 arrangement of product holding containers C in an interior 106 of the construct 105, and a package 107 of the present disclosure can be formed by providing the shipping dispensing construct 105 with one or more of the product holding containers C attached thereto. The package 107 can thus be shipped to a point of sale vendor (e.g., department store, grocery store, etc.) for sale to a consumer. The package 107, shipping dispensing construct 105, and/or construct blank 103 can have other features and can be alternatively shaped, arranged, and/or configured without departing from the disclosure.

Figure 4:
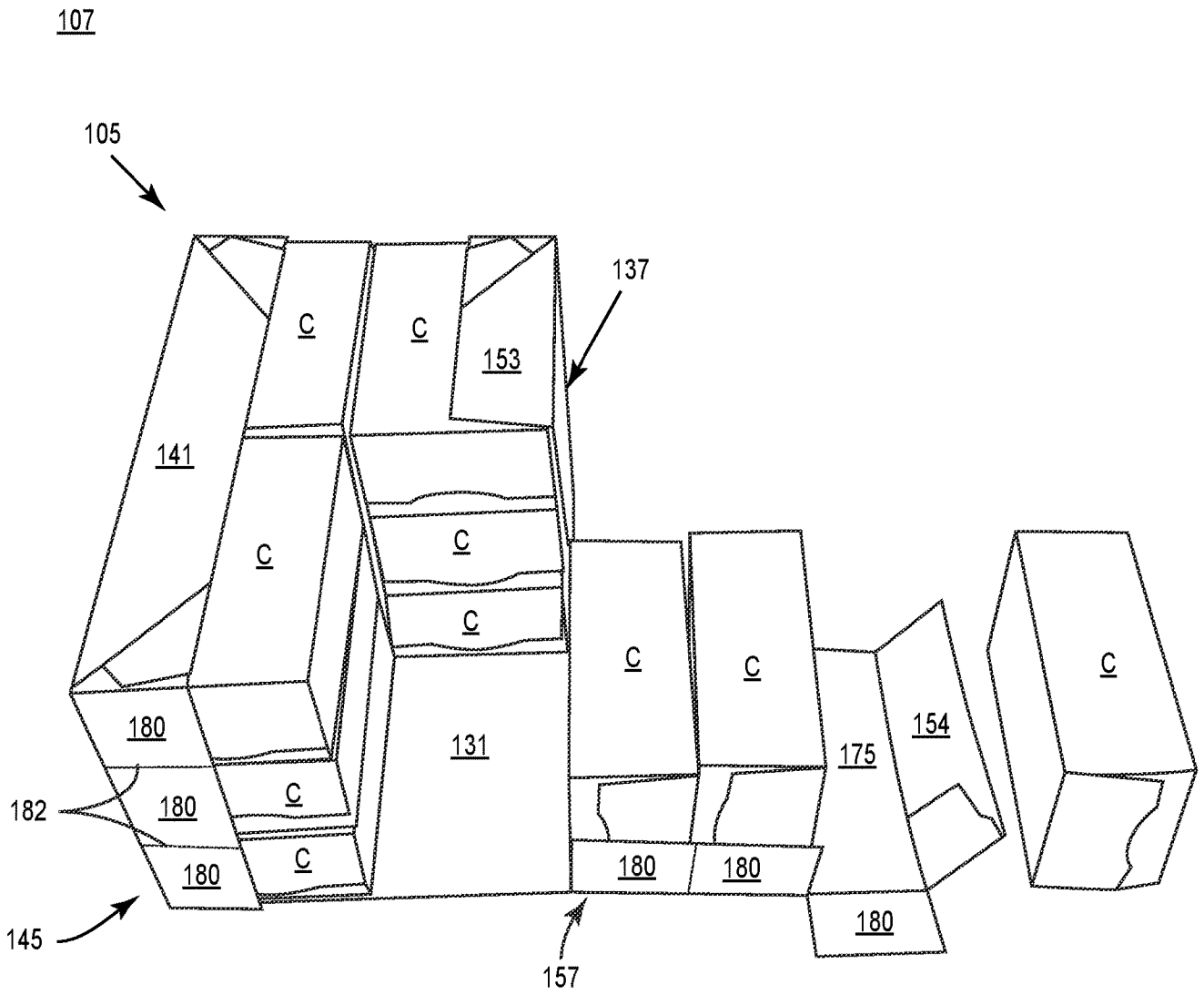
FIG. 4 is a perspective view of product holding containers being dispensed from the package and shipping and dispensing construct of FIG. 3.

With reference to FIG. 4, in one embodiment, one or more of the panels 144, 149, 141, 145, 151, 153, 157, 161 can be separated from the respective product holding containers C and positioned away therefrom to provide access to one or more of the containers C. It will be understood that such access can be provided to a group of the product holding containers C that can be a single product holding container C or a plurality of product holding containers C.

In another embodiment, one or both of the portion 167, 169 of the bottom panel 133 and/or one or both of the sections 175, 177 of the top panel 137 can be separated along the respective tear line 165, 173 to provide access or cause dispensing, in bulk, of an entire tier/row/column of product holding containers C with the respective portion 167, 169, 175, 177. It will be understood that separation of a portion 167, 169, 175, 177 along a respective tear line can also cause a portion of a respective back panel 141, 153 foldably connected thereto to separate along such tear line.

Upon bulk removal of a tier/row/column of product holding containers C with a respective portion 167, 169, 175, 177, individual product holding containers C can further optionally be dispensed therefrom by separating a respective container C from a respective portion 167, 169, 175, 177. It will be understood that such separation of a container C from a respective portion 167, 169, 175, 177 can also involve separation of the container C from a portion of a respective panel 141, 145, 151, 153, 157, 161 that is additionally attached thereto.

In one embodiment, one or more of the panel sections 180 can be separated from a respective adjacent panel section 180 at a respective tear line 182 to facilitate access and/or selective removal of product holding containers C from the construct 105 in a modular fashion.

Accordingly, one or more of the bottom panel 133, the top panel 137, the side panels 145, 149, 157, 161, and the back panels 141, 153 can form dispensing portions of the package 107/construct 105.

In view of the foregoing, the disclosed package 107/shipping and dispensing construct 105 provides for selective and modular and/or bulk dispensing of product holding containers therefrom in an arrangement that is versatile, robust due to multiple points of attachment, and provides ready visibility of the containers C to a consumer. In addition, the front panel 131 can provide a suitable surface for printed indicia, for example, product, pricing, or advertising information. It will be understood that the interior of the package 107/construct 105 can also facilitate printing for additional product, priding, or advertising information in the form of coupons, incentives or giveaways associated with social media, etc.

Figure 6:
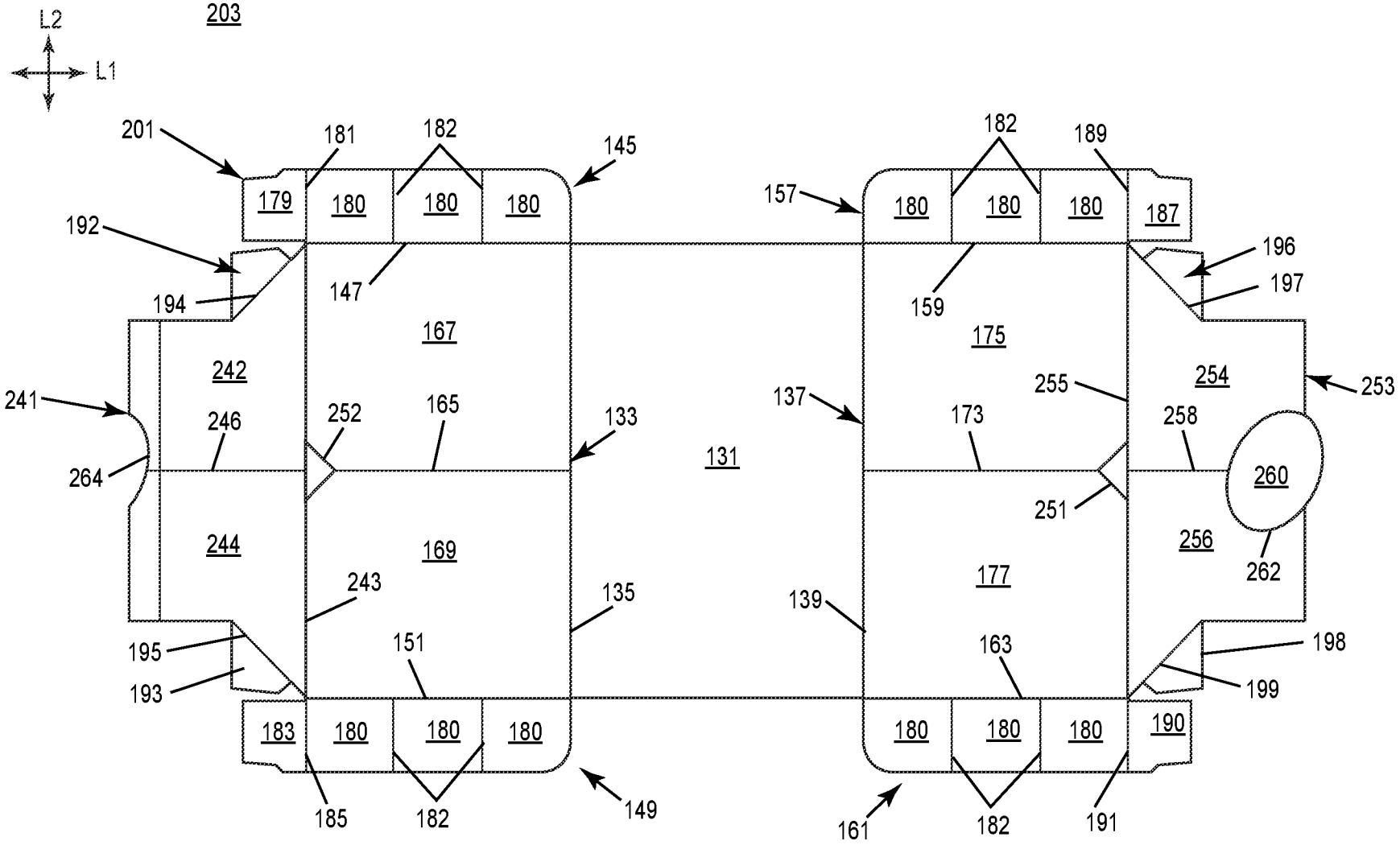
FIG. 6 is a plan schematic view of an exterior surface of a construct blank for forming a shipping and dispensing construct according to a second exemplary embodiment of the disclosure.
Figure 8:
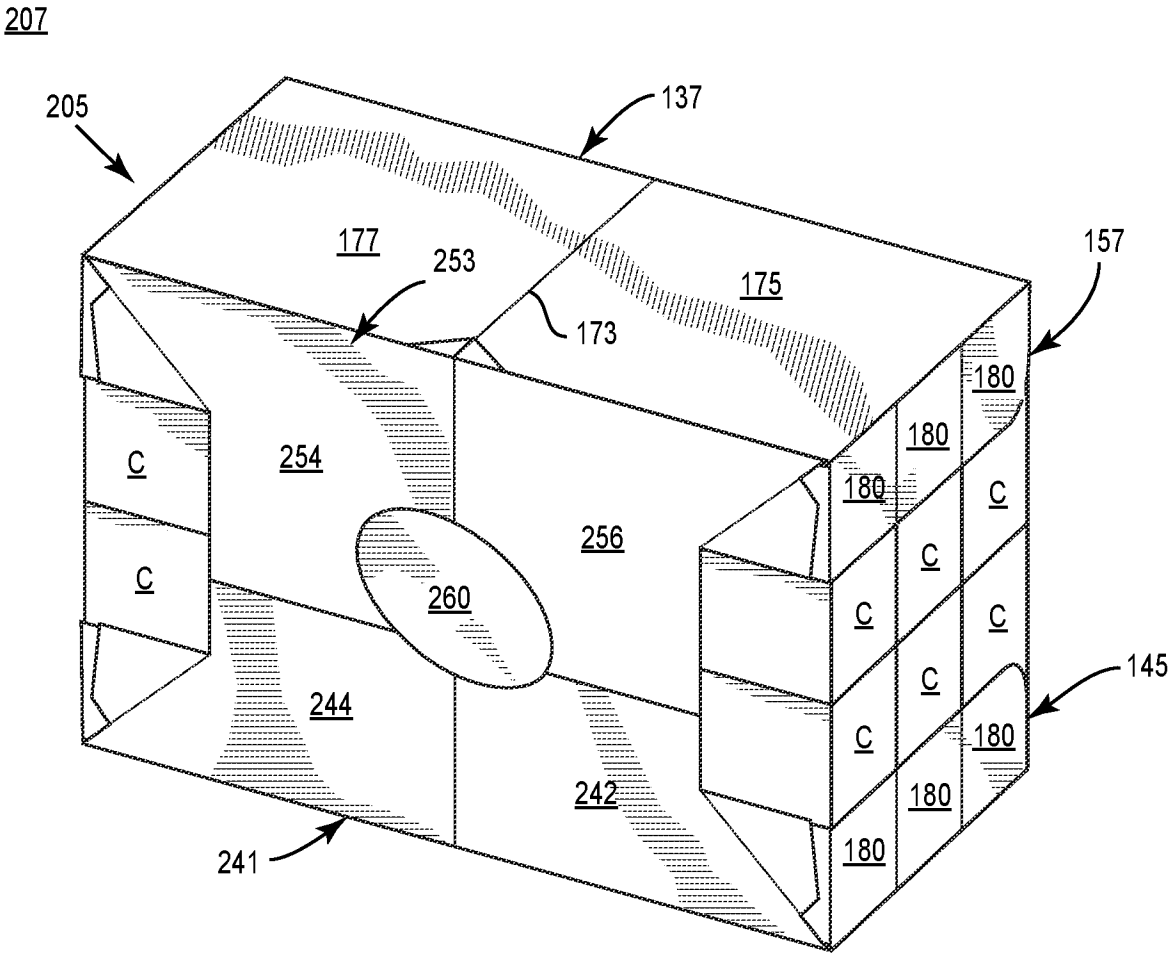
FIG. 8 is a perspective view of a package and shipping and dispensing construct formed from the blank of FIG. 6 according to the second exemplary embodiment.

Turning to FIG. 6, an exterior surface 201 of a construct blank 203 for forming a shipping and dispensing construct 205 (FIG. 8) according to a second exemplary embodiment of the disclosure is illustrated. The construct blank 203 and the shipping and dispensing construct 205 formed therefrom can have one or more features that are the same or similar to those of the construct blank 103 and the shipping and dispensing construct 105 of the first exemplary embodiment, and like or similar reference numerals are provided for like or similar features. The construct 205 can be provided with one or more of the product holding containers C attached thereto as a package 207 (FIG. 8).

The construct blank 203 has the longitudinal axis L1 and the lateral axis L2. As shown, the construct blank 203 includes the front panel 131, the bottom panel 133, the top panel 137, the side panels 145, 149, 157, 161, and the end flaps/flaps 179, 183, 187, 190, 192, 193, 196, 198.

The construct blank 203 can also include a bottom back panel 241 foldably connected to the bottom panel 133 at a lateral fold line 243 and a top back panel 253 foldably connected to the bottom panel 137 at a lateral fold line 255. As also shown, discontinuities 252, 251 e.g., openings or apertures, can be positioned in the panels adjacent the endpoints of the respective tear lines 165, 173. In this regard, the back panel 241 is bisected into a first portion 242 and a second portion 244 at a tear line 246 that is collinear with the tear line 165, and the bottom back panel 253 is bisected into a first portion 254 and a second portion 256 at a tear line 258 that is collinear with the tear line 173.

As described herein, the portions 167, 169 of the bottom panel 133 and/or the portions 242, 244 of the bottom back panel 241 can form dispensing portions of the shipping and dispensing construct 205. Similarly, the portions 167, 169 of the top panel 137 and/or the portions 254, 256 of the top back panel 253 can form dispensing portions of the shipping and dispensing construct 205 that are separable from a remainder of the shipping and dispensing construct 205.

In addition, an access panel 260 can be separably connected to each of the first portion 254 and the second portion 256 of the back panel 253 at a respective portion of a curved cut/tear line 262 that intersects the tear line 258. As described further herein, the access panel 260 can have a generally curved/ovoid configuration that is complementary to a recessed curved edge 264 (FIG. 7) along a free edge of the bottom back panel 241.

Figure 7:
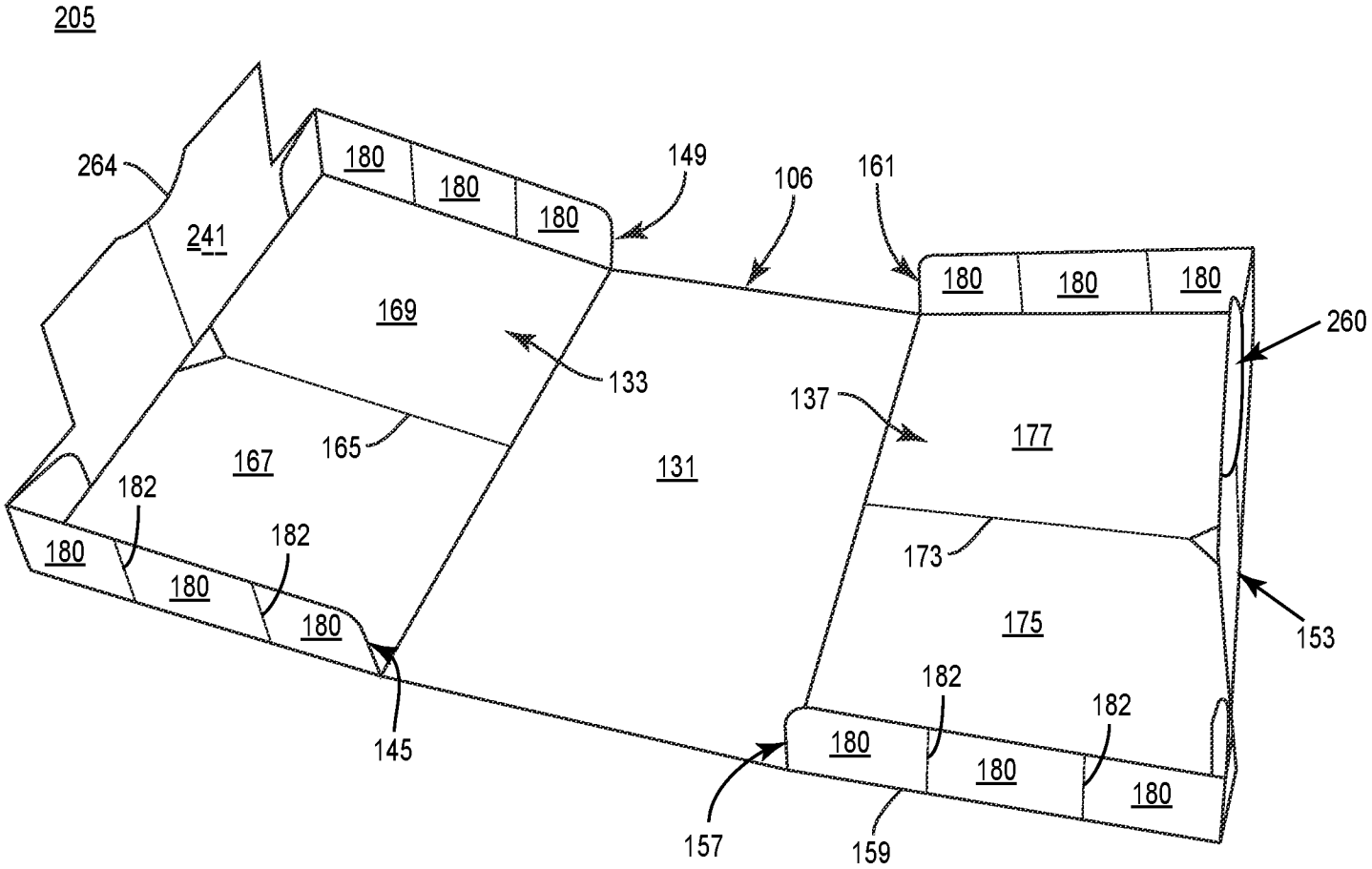
FIG. 7 is a perspective view of a partially folded configuration of a shipping and dispensing construct formed from the blank of FIG. 6 according to the second exemplary embodiment.

Turning additionally to FIGS. 7 and 8, the shipping and dispensing construct 205 can be formed from the construct blank in a substantially similar manner to that described above with regard to the shipping and dispensing construct 105 of the first exemplary embodiment, and the back panels 241, 253 can be positioned such that a curved free edge of the access panel 260 is positioned to engage/abut the curved edge 264 of the back panel 241 and such that the access panel 260 extends from the top back panel 254 to the bottom back panel 241.

Figure 9:
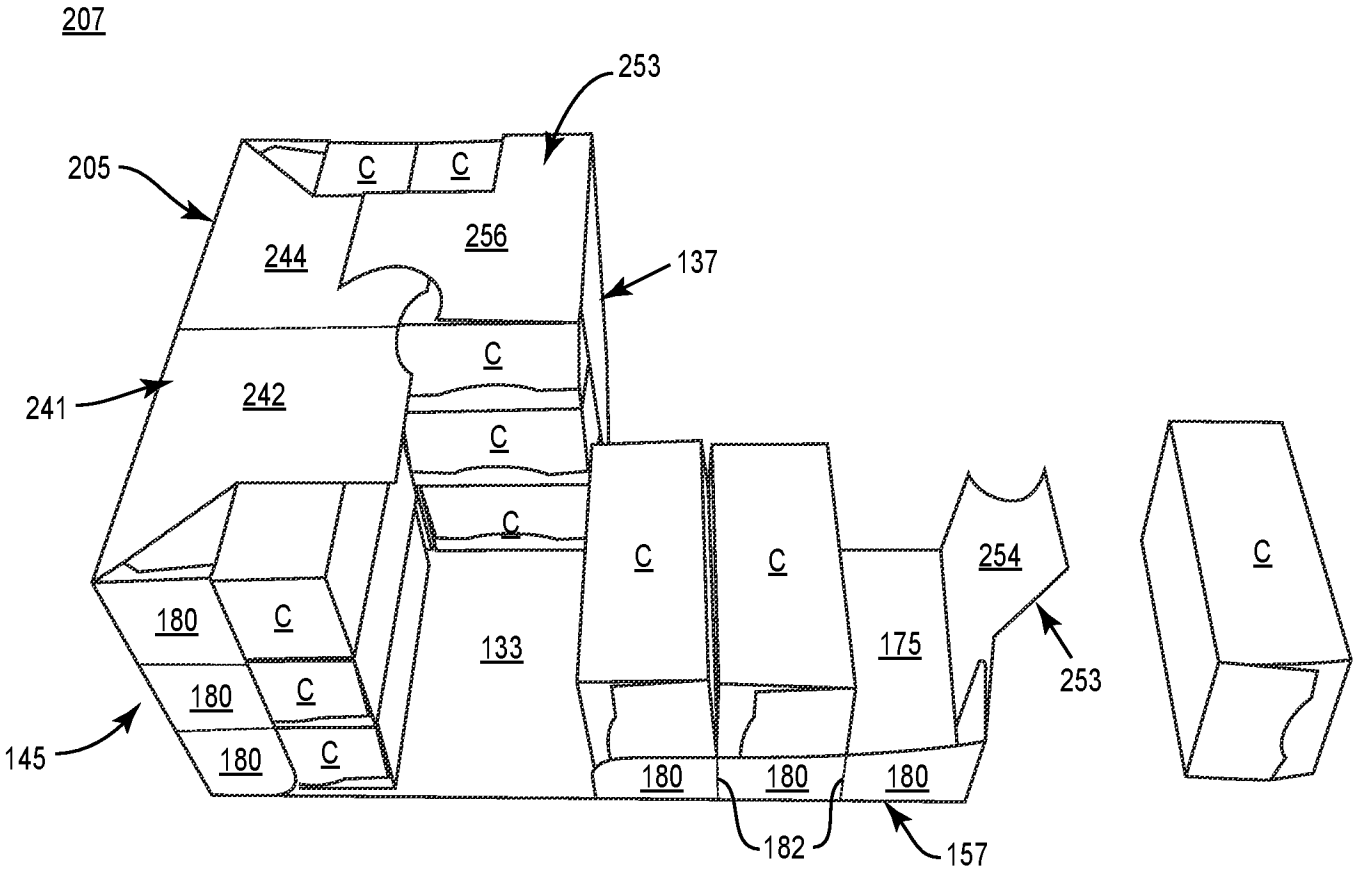
FIG. 9 is a perspective view of product holding containers being dispensed from the package and shipping and dispensing construct of FIG. 8.

In this regard, and with additional reference to FIG. 9, the access panel 260 can be separated from the portions 242, 244 of the back panel 241 so as to provide free edges of the back panel 241 from which one or both of the portions 242, 244 can be easily separated at the tear line 246 to effect dispensing of product holding containers C from the shipping and dispensing construct 205 as described above with regard to the construct 105. Similarly, the removal of the access panel 260 exposes free edges of the back panel 253 to provide for convenient separation of one or both of the portions 254, 256 at the tear line 258.

Accordingly, one or more of the top panel 133, the bottom panel 137, the side panels 145, 149, 157, 161, and the back panels 241, 253, and the access panel 260 can form dispensing portions of the package 207/construct 205. In this regard, the package 207/shipping and dispensing construct 205 can dispense product holding containers C in a manner similar to that described above with regard to the package 107/construct 105.

In view of the foregoing, the disclosed package 207/shipping and dispensing construct 205 provides for selective and modular and/or bulk dispensing of product holding containers C therefrom in an arrangement that is versatile, robust due to multiple points of attachment, and provides ready visibility of the containers C to a consumer. In addition, the front panel 131 and/or the access panel 260 can provide a suitable surface for printed indicia, for example, product, pricing, or advertising information.

It will be understood that construct blanks, shipping and dispensing constructs, and/or packages disclosed herein can have other features and can be alternatively shaped, arranged, and/or configured without departing from the disclosure. For example, FIGS. 27-34 illustrate alternative embodiments for construct blanks for forming shipping and dispensing constructs and packages therefrom according to alternative embodiments of the disclosure.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A shipping and dispensing construct for engaging a plurality of product holding containers, the shipping and dispensing construct comprising:

a plurality of panels extending at least partially around an interior of the shipping and dispensing construct and comprising a front panel, a top panel, a bottom panel, at least one side panel, and at least one back panel; and dispensing features for removal of a group of the plurality of the product holding containers, the dispensing features including a plurality of dispensing portions comprising at least a portion of at least one of the top panel and the bottom panel and at least a portion of the at least one side panel, the dispensing portions being separable from a remainder of the shipping and dispensing construct for allowing access to a group of the plurality of product holding containers, the at least a portion of the at least one side panel comprises a plurality of panel sections, each panel section foldably connected to the bottom panel at a fold line and separably attached to an adjacent panel section at a respective tear line, each panel section for being attached to respective product holding containers of the plurality of product holding containers.

2. The shipping and dispensing construct of claim 1, wherein the at least a portion of at least one of the top panel and the bottom panel comprises a respective plurality of separable portions for attachment to a respective container of the plurality of product holding containers, each respective plurality of separable portions comprises a first portion separably connected to a second portion at a tear line.

3. The shipping and dispensing construct of claim 2, wherein the at least one side panel is a first top side panel foldably connected to the top panel, and the plurality of panels further comprises a second top side panel foldably connected to the top panel, a first bottom side panel foldably connected to the bottom panel, and a second bottom side panel foldably connected to the bottom panel, and the plurality of dispensing portions further comprises a respective plurality of panel sections of each of the second top side panel, the first bottom side panel, and the second bottom side panel, each panel section separably attached to a respective adjacent panel section at a respective tear line.

4. The shipping and dispensing construct of claim 3, further comprising a top back panel foldably connected to the top panel and a bottom pack panel foldably connected to the bottom panel.

5. The shipping and dispensing construct of claim 4, wherein the plurality of dispensing portions further comprises a first portion of the top back panel separably connected to a second portion of the top back panel, and the plurality of dispensing portions further comprises a first portion of the bottom back panel separably connected to a second portion of the bottom back panel.

6. The shipping and dispensing construct of claim 4, wherein the plurality of panels further comprises an access panel separably attached to one of the top back panel and the bottom back panel.

7. The shipping and dispensing construct of claim 6, wherein the access panel extends from the top back panel to the bottom back panel.

8. The shipping and dispensing construct of claim 7, wherein the access panel is separably connected to the top back panel at a curved tear line and the bottom back panel comprises a curved free edge that abuts the access panel.

9. The shipping and dispensing construct of claim 1, wherein at least one of the top panel and the bottom panel comprises a plurality of lines of weakening to facilitate separation of the dispensing portions from the remainder of the shipping and dispensing construct.

10. The shipping and dispensing construct of claim 1, wherein each panel section is positioned for being in at least partial face-to-face contact with respective product holding containers of the plurality of product holding containers.

11. A construct blank for forming a shipping and dispensing construct for engaging a plurality of product holding containers, the construct blank comprising:

a plurality of panels for extending at least partially around an interior of the shipping and dispensing construct formed from the blank and comprising a front panel, a top panel, a bottom panel, at least one side panel, and at least one back panel; and dispensing features for facilitating selective dispensing of one or more of the product holding containers when the shipping and dispensing construct is formed from the construct blank, the dispensing features including a plurality of dispensing portions comprising a plurality of separable portions of at least one of the top panel and the bottom panel and at least a portion of the at least one side panel for attachment to a respective container of the plurality of product holding containers, the at least a portion of the at least one side panel comprises a plurality of panel sections, each panel section foldably connected to the bottom panel at a fold line and separably attached to an adjacent panel section at a respective tear line, each panel section for being attached to respective product holding containers of the plurality of product holding containers when the shipping and dispensing construct is formed from the construct blank.

12. The construct blank of claim 11, wherein the at least a portion of at least one of the top panel and the bottom panel comprises a respective plurality of separable portions for attachment to a respective container of the plurality of product holding containers, each respective plurality of separable portions comprises a first portion separably connected to a second portion at a tear line.

13. The construct blank of claim 12, wherein the at least one side panel is a first top side panel foldably connected to the top panel, and the plurality of panels further comprises a second top side panel foldably connected to the top panel, a first bottom side panel foldably connected to the bottom panel, and a second bottom side panel foldably connected to the bottom panel, and the plurality of dispensing portions further comprises a respective plurality of panel sections of each of the second top side panel, the first bottom side panel, and the second bottom side panel, each panel section separably attached to a respective adjacent panel section at a respective tear line.

14. The construct blank of claim 13, further comprising a top back panel foldably connected to the top panel and a bottom pack panel foldably connected to the bottom panel.

15. The construct blank of claim 14, wherein the plurality of dispensing portions further comprises a first portion of the top back panel separably connected to a second portion of the top back panel, and the plurality of dispensing portions further comprises a first portion of the bottom back panel separably connected to a second portion of the bottom back panel.

16. The construct blank of claim 14, wherein the plurality of panels further comprises an access panel separably attached to one of the top back panel and the bottom back panel.

17. The construct blank of claim 11, wherein at least one of the top panel and the bottom panel comprises a plurality of lines of weakening to facilitate separation of the dispensing portions from the remainder of the shipping and dispensing construct when the shipping and dispensing construct is formed from the construct blank.

18. The construct blank of claim 11, wherein each panel section is for being positioned in at least partial face-to-face contact with respective product holding containers of the plurality of product holding containers when the shipping and dispensing construct is formed from the construct blank.

19. A method of forming a shipping and dispensing construct, the method comprising:

obtaining a construct blank comprising a plurality of panels comprising a front panel, a top panel, a bottom panel, at least one side panel, and at least one back panel, and dispensing features including a plurality of dispensing portions comprising at least a portion of at least one of the top panel and the bottom panel and at least a portion of the at least one side panel, the at least a portion of the at least one side panel comprises a plurality of panel sections, each panel section foldably connected to the bottom panel at a fold line and separably attached to an adjacent panel section at a respective tear line; and folding the plurality of panels at least partially around an interior of the shipping and dispensing construct such that the dispensing portions are separable from a remainder of the shipping and dispensing construct and such that each panel section is positioned for being attached to respective product holding containers of the plurality of product holding containers.

20. The method of claim 19, further comprising attaching the plurality of product holding containers to a respective dispensing portion of the plurality of dispensing portions.

21. The method of claim 20, further comprising separating one or more dispensing portions from the remainder of the shipping and dispensing construct to access to a group of the plurality of product holding containers.

22. The method of claim 19, wherein the at least a portion of at least one of the top panel and the bottom panel comprises a respective plurality of separable portions for attachment to a respective container of the plurality of product holding containers, each respective plurality of separable portions comprises a first portion separably connected to a second portion at a tear line.

23. The method of claim 22, wherein the at least one side panel is a first top side panel foldably connected to the top panel, and the plurality of panels further comprises a second top side panel foldably connected to the top panel, a first bottom side panel foldably connected to the bottom panel, and a second bottom side panel foldably connected to the bottom panel, and the plurality of dispensing portions further comprises a respective plurality of panel sections of each of the second top side panel, the first bottom side panel, and the second bottom side panel, each panel section separably attached to a respective adjacent panel section at a respective tear line.

24. The method of claim 23, further comprising a top back panel foldably connected to the top panel and a bottom pack panel foldably connected to the bottom panel.

25. The method of claim 24, wherein the plurality of dispensing portions further comprises a first portion of the top back panel separably connected to a second portion of the top back panel, and the plurality of dispensing portions further comprises a first portion of the bottom back panel separably connected to a second portion of the bottom back panel.

26. The method of claim 24, wherein the plurality of panels further comprises an access panel separably attached to one of the top back panel and the bottom back panel.

27. The method of claim 26, wherein the plurality of panels are folded such that the access panel extends from the top back panel to the bottom back panel.

28. The method of claim 27, wherein the access panel is separably connected to the top back panel at a curved tear line and the bottom back panel comprises a curved free edge that abuts the access panel.

29. The method of claim 19, wherein at least one of the top panel and the bottom panel comprises a plurality of lines of weakening to facilitate separation of the dispensing portions from the remainder of the shipping and dispensing construct.

30. The method of claim 19, wherein folding the plurality of panels comprises positioning each panel section for being in at least partial face-to-face contact with respective product holding containers of the plurality of product holding containers.

31. A package comprising:

a plurality of product holding containers; and a shipping and dispensing construct engaging the plurality of product holding containers, the shipping and dispensing construct comprising:

a plurality of panels extending at least partially around an interior of the package and comprising a front panel, a top panel, a bottom panel, at least one side panel, and at least one back panel; and dispensing features for removal of a group of the plurality of the product holding containers, the dispensing features comprising a plurality of dispensing portions including at least a portion of at least one of the top panel and the bottom panel and at least a portion of the at least one side panel, the dispensing portions being separable from a remainder of the shipping and dispensing construct for allowing access to the group of the plurality of product holding containers, the at least a portion of the at least one side panel comprises a plurality of panel sections, each panel section foldably connected to the bottom panel at a fold line and separably attached to an adjacent panel section at a respective tear line, each panel section attached to respective product holding containers of the plurality of product holding containers.

32. The package of claim 31, wherein the at least a portion of at least one of the top panel and the bottom panel comprises a respective plurality of separable portions attached to a respective container of the plurality of product holding containers, each respective plurality of separable portions comprises a first portion separably connected to a second portion at a tear line.

33. The package of claim 32, wherein the at least one side panel is a first top side panel foldably connected to the top panel, and the plurality of panels further comprises a second top side panel foldably connected to the top panel, a first bottom side panel foldably connected to the bottom panel, and a second bottom side panel foldably connected to the bottom panel, and the plurality of dispensing portions further comprises a respective plurality of panel sections of each of the second top side panel, the first bottom side panel, and the second bottom side panel, each panel section separably attached to a respective adjacent panel section at a respective tear line.

34. The package of claim 33, further comprising a top back panel foldably connected to the top panel and a bottom pack panel foldably connected to the bottom panel.

35. The package of claim 34, wherein the plurality of dispensing portions further comprises a first portion of the top back panel separably connected to a second portion of the top back panel, and the plurality of dispensing portions further comprises a first portion of the bottom back panel separably connected to a second portion of the bottom back panel.

36. The package of claim 34, wherein the plurality of panels further comprises an access panel separably attached to one of the top back panel and the bottom back panel.

37. The package of claim 36, wherein the access panel extends from the top back panel to the bottom back panel.

38. The package of claim 37, wherein the access panel is separably connected to the top back panel at a curved tear line and the bottom back panel comprises a curved free edge that abuts the access panel.

39. The package of claim 31, wherein at least one of the top panel and the bottom panel comprises a plurality of lines of weakening to facilitate separation of the dispensing portions from the remainder of the shipping and dispensing construct.

40. The package of claim 31, wherein each panel section is positioned in at least partial face-to-face contact with respective product holding containers of the plurality of product holding containers.

* * * * *